US005125519A

United States Patent [19]

Cambria

[11] Patent Number: 5,125,519

[45] Date of Patent: Jun. 30, 1992

[54] ARTICLE STORAGE SYSTEM

[76] Inventor: Susan K. Cambria, 576 Broadview Rd., Orange, Conn. 06477

[21] Appl. No.: 616,778

[22] Filed: Nov. 20, 1990

[51] Int. Cl.[5] ..... A47F 5/00

[52] U.S. Cl. ..... 211/118; 211/113

[58] Field of Search ..... 211/113, 118, 34, 38, 211/88

[56] References Cited

U.S. PATENT DOCUMENTS

| | | | |
|---|---|---|---|
| 3,063,570 | 11/1962 | Kroner | 211/113 |
| 3,116,773 | 1/1964 | Kikas . | |
| 3,327,419 | 6/1967 | Stanos . | |
| 3,331,513 | 7/1967 | Cappelli | 211/34 |
| 3,669,276 | 6/1972 | Woods | 211/34 |
| 3,918,670 | 11/1975 | Doherty . | |
| 4,387,873 | 6/1983 | Pavlo et al. | 211/113 X |
| 4,585,127 | 4/1986 | Benedict | 211/34 |
| 4,817,805 | 4/1989 | Rodriguez | 211/113 X |
| 5,027,960 | 7/1991 | Rainville | 211/118 |

*Primary Examiner*—Robert W. Gibson, Jr.
*Attorney, Agent, or Firm*—Bachman & Lapointe

[57] ABSTRACT

A system for storing articles, particularly children's playthings, includes a substantially solid, substantially planar base sheet and one or more packets for holding articles detachably secured to the base sheet by Velcro fasteners. The base sheet has a plurality of grommets adjacent an upper edge for allowing the sheet and thereby the system to be mounted to another object. The base sheet may also be folded into a carrying case for transporting articles.

17 Claims, 3 Drawing Sheets

ARTICLE STORAGE SYSTEM

BACKGROUND OF THE INVENTION

The present invention relates to a device for storing articles, particularly children playthings. The device of the present invention is portable, capable of being mounted to a house fixture or an object of furniture, and may be easily used by both adults and children.

Systems for storing articles that can be mounted to wall, doors and the like are well known in the art. For example, U.S. Pat. No. 3,918,670 to Doherty illustrates a rack for storing shoes which may be suspended from the upper edge of a door by hooks. U.S. Pat. No. 3,063,570 to Krener illustrates a holder for storing handbags. The holder comprises two parallel strips of tape fixed to a means for suspending the holder from a rod and a number of pockets extending between the tapes. The pockets are used to store individual handbags.

U.S. Pat. No. 3,327,419 to Stanos illustrates a card display device having Velcro pieces for mounting a plurality of cards to a support strip.

U.S. Pat. No. 3,116,773 to Kikas exemplifies a storage system in which two straps, each including a row of snap fasteners, are mounted to a planar surface such as a door. The storage system further includes a number of fabric bag compartments detachably mounted to the strips by the snap fasteners. Each of the compartments has a pocket open at one end and trimmed with elastic.

None of the foregoing storage devices are designed either for children's playthings or for use by children. Many of these storage devices are also not designed to be transported while articles are stored in them. The use of open-ended pockets allows the contents to spill out—something which is undesirable when transporting articles such as crayons or building blocks.

SUMMARY OF THE INVENTION

Accordingly, it is an object of the present invention to provide a device for storing children's playthings.

It is a further object of the present invention to provide a device as above which may be easily used by adults and children.

It is still a further object of the present invention to provide a device as above which is portable and easily mountable to surfaces or objects.

It is yet another object of the present invention to provide a device as above which can be easily transported with articles stored therein.

These and other objects and advantages of the present invention will become clearer from the following description and drawings in which like reference numerals depict like elements.

The storage device of the present invention is specifically designed for the storage of children's playthings, although it may also be used to store other articles. The device has a substantially solid, substantially planar base sheet formed from a flexible material, preferably clear vinyl plastic. The base sheet has a number of Velcro strips extending in a longitudinal direction to which a series of packets for storing articles can be attached. The base sheet also has a number of grommets at one end which allow the storage device to be suspended from hooks.

Each of the packets for storing the articles is formed from the same material as the base sheet. The packets have a strip of Velcro material extending across a back surface for allowing the packet to be detachably mounted to the base sheet at any desired location. In a preferred embodiment, the packet includes a sealing flap for closing the packet and means for securing the flap in a closed position.

The base sheet further includes a Velcro strip adjacent its lower edge. The Velcro strip allows the base sheet with one or more packets mounted thereto to be folded into a carrying case. The base sheet also has a handle attached to it for facilitating transport of the storage device when it is formed into a carrying case.

DETAILED DESCRIPTION

The article storage device of the present invention will now be discussed with reference to the figures. While the invention will be discussed in the context of a device for storing children's playthings, it should be recognized that it may in actuality be used to store other articles such as clothing, books, etc.

The storage device 10 includes a substantially solid, substantially planar base sheet 12 formed from a flexible material such as canvas, cloth or plastic. In a preferred embodiment, the sheet 12 is formed from a clear, see through vinyl plastic.

Figure 2:
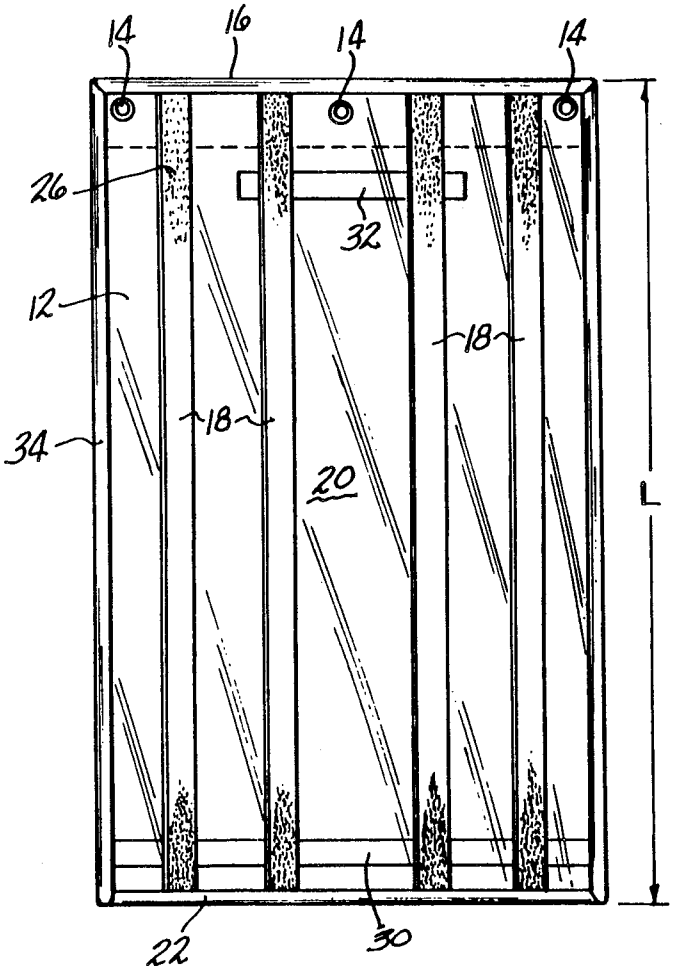
FIG. 2 is a front view of the base sheet.
Figure 3:
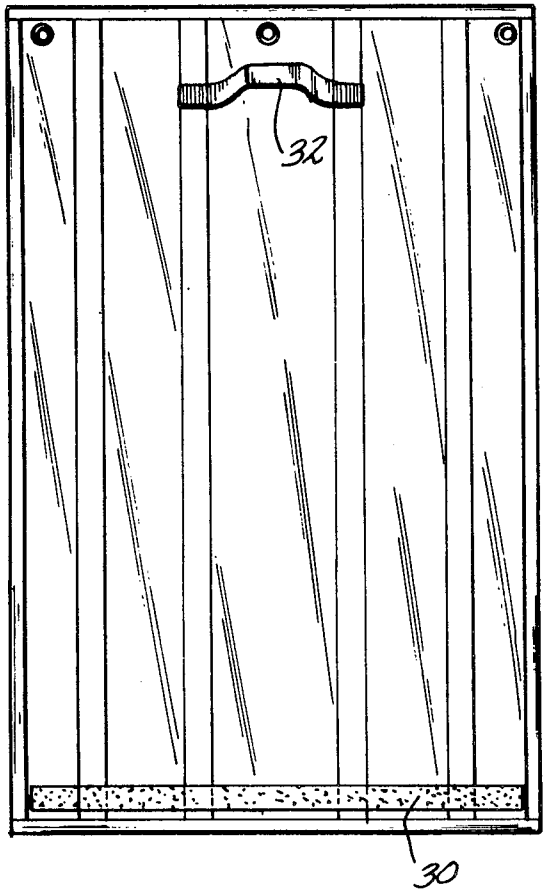
FIG. 3 is a back view of the base sheet.

The sheet 12 may have any desired shape, any desired length L and any desired width. Preferably, the sheet has a substantially rectangular shape as shown in FIGS. 2 and 3.

A series of brass grommets 14 are positioned in the base sheet 12 adjacent an upper edge 16. In this area, the material forming the base sheet is folded over and stitched together for increased strength. If desired, a strip of vinyl reinforcement material may be provided for added strength to hold the grommets 14.

The grommets 14 allow the base sheet to be suspended from hooks mounted to a support such as a wall or a door. The grommets also allow other types of mounting arrangements to be used with the storage device 10. For example, a hook or hanger (not shown) joined to a piece of cloth, a chain, or a ribbon may be secured to the base sheet by passing an end of the cloth or ribbon through one or more of the grommets 14 and forming a suitable knot in the end. Alternatively, a mounting device such as a hanger may be connected by a hook which engages the eye of the grommet and a length of chain. If desired, the central grommet may be replaced by a dowel support.

The base sheet 12 further includes a number of longitudinally extending strips 18 attached to a first or front surface 20 of the sheet 12. The strips 18 substantially extend from the upper edge 16 to the lower edge 22 of the sheet 12. They may be mounted to the sheet material in any suitable manner. For example, each strip 18 may be stitched to the sheet material. Alternatively, each strip 18 may be glued to the sheet material.

The strips 18, as will be discussed in more detail hereinafter, serve to secure one or more packets 24 to the base sheet 12. Preferably, each of the strips 18 has an adhesive surface 26 formed by Velcro fasteners. While the base sheet 12 has been illustrated as having four longitudinally extending strips 18, it should be recognized that any number of strips can be provided. For example, the sheet 12 may have only two longitudinally extending strips 18.

Figure 7:
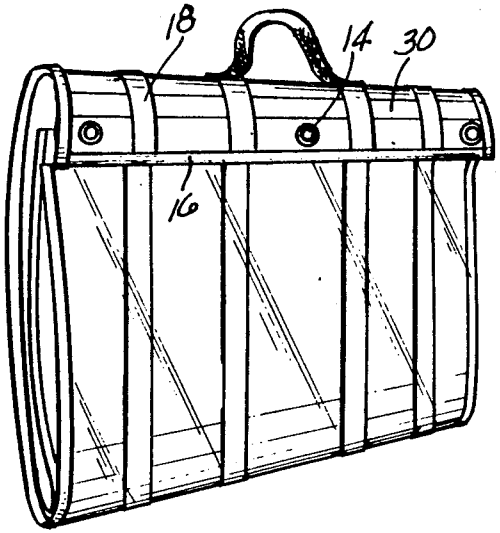
FIG. 7 illustrates the article storage device of the present invention in a folded condition.

The sheet 12 further has adhesive strip 30 attached to it adjacent a lower portion. The strip 30 extends substantially perpendicular to the strips 18 and is secured to a rear face of the sheet, at a desired distance from the upper edge 16. When the sheet 12 is folded to form the carrying case shown in FIG. 7, the adhesive surface of an upper portion of each strip 18 contacts the adhesive surface of strip 30 and holds the base sheet in a closed and folded position.

In a preferred embodiment, strip 30 is a Velcro strip. As before, strip 30 may be secured to the base sheet in any suitable manner known in the art, i.e., gluing, stitching, etc.

A handle 32 can also be provided on the rear face of the sheet 12 to facilitate carrying the device when it is in a folded position. The handle 32 may comprise a fabric strip affixed to the sheet 12 and positioned approximately 2" from the upper edge 16.

A binding 34 may be provided around the periphery of the base sheet 12. The binding 34 may comprise a piece of material such as canvas stitched to the periphery of the sheet. The binding 34 serves to reinforce the edges of the base sheet and improve the aesthetic appearance of the device 10.

As previously mentioned the sheet 12 may come in a variety of sizes. For example, the sheet 12 may be 15" in length × 18" in width; or 30" in length × 18" in width; or 45" in length × 18" in width; or 60" in length × 18" in width.

The packets 24 each comprise a detachable envelope for storing children's playthings and the like. Each packet 24 comprises a storage compartment defined by the inner surface of a rear wall 42 and a front wall 40. The packet has an access opening adjacent an upper edge of the front wall 40. Each packet further has an integral flap 44 for sealing the opening and the envelope. The flap 44 is formed integrally with the rear wall.

A strip 46 of adhesive material, e.g., a Velcro strip, is affixed to the outer surface of the rear wall 42. The strip 46 runs substantially the entire width of the packet 24 and is used to secure the packet to the base sheet 12 via the strips 18. Preferably, the strip 46 extends in a direction substantially perpendicular to the strips 18 when the packet is affixed to the sheet and is positioned in an upper portion of the packet 24.

The packet 24 further includes strips 48 of adhesive material for sealing the flap 44 against the exterior surface of the front wall 42. The strips 48 are preferably positioned adjacent each side edge of the envelope and on mating portions of the flap 44. The strips 48 may also be formed from Velcro material.

Figure 4:
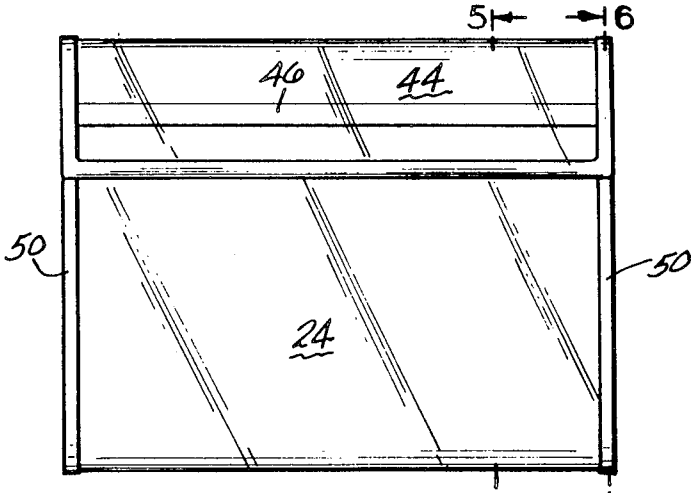
FIG. 4 is a front view of a storage packet.
Figure 6:
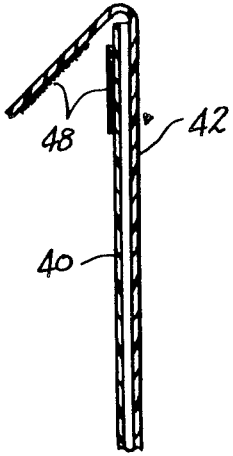
FIG. 6 is a side view of a storage packet in cross-section with the sealing flap in an open position.
Figure 5:
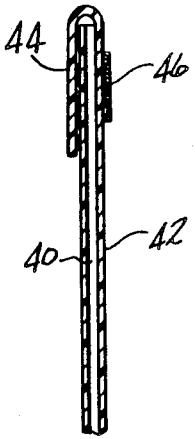
FIG. 5 is a side view of a storage packet in cross-section.

The packets may have any desired width, length and shape. For example, the packets 24 may take the form of the envelope shown in FIG. 4 or may be square in shape. The packets 24 may have a width which is just less than the width of the sheet 12 or may have a width which is a fraction of the sheet width, e.g., ½ width.

A binding 50 is placed along edge portions of the packet 24. The binding may be formed from a cloth fabric or canvas and stitched to the packet 24. The binding 50 serves to strengthen the edges of the packet 50 as well as improve its aesthetic appearance.

The packet 24 itself may be formed from a wide range of materials. Preferably, it is formed from the same material as the sheet 12. Thus, in a preferred embodiment, each packet 24 is formed from a clear, see-through vinyl.

Figure 1:
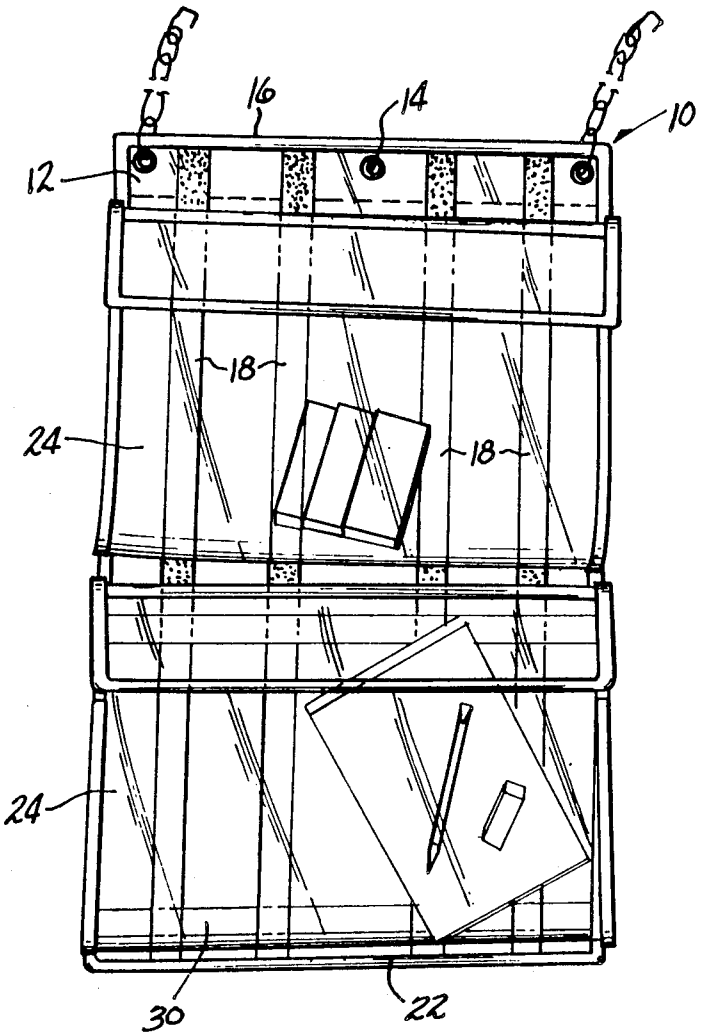
FIG. 1 is a perspective view of the article storage device of the present invention.

Two or more packets 24 of identical sizes may be mounted to the base sheet 12 as shown in FIG. 1 to form an article storage device. If desired, the packets 24 may be mounted to the base sheet so that one packet overlaps an adjacent packet.

Figure 9:
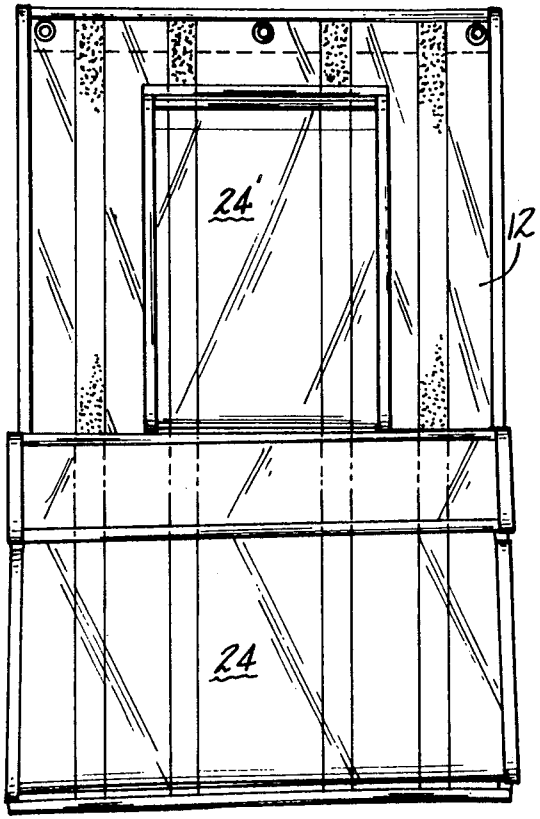
FIG. 9 illustrates yet another alternative embodiment of the present invention.
Figure 8:
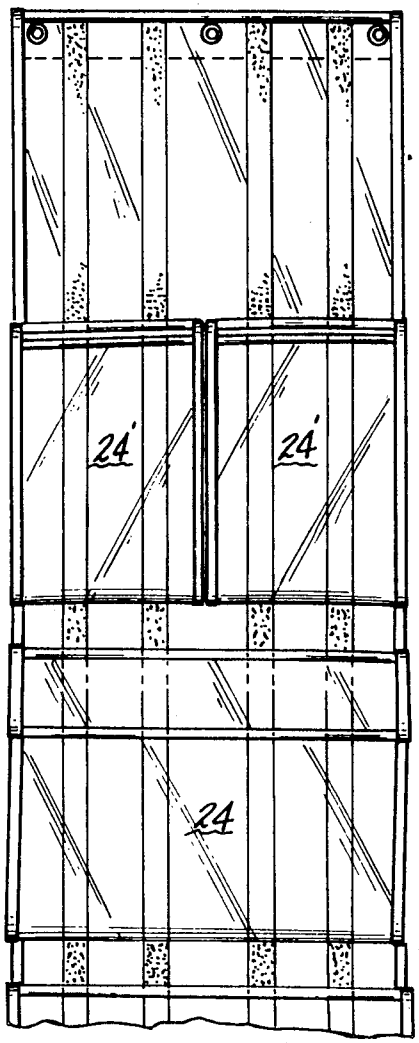
FIG. 8 illustrates an alternative embodiment of the article storage device.

Alternatively, packets of different sizes may be mounted to the sheet. For example, the storage device may have a full size packet 24 and two half-size packets 24' mounted to the base sheet 12 as shown in FIG. 8. In another arrangement, the storage device may have a full size packet 24 and a centrally positioned half-size 24' packet as shown in FIG. 9.

The packet 24 may be used to store any number of objects. For example, the packets may be used to store crayons, animal figures, puzzles, books, toy blocks, etc. They can be easily removed from the base sheet merely by pulling the packet with sufficient force to release the Velcro fasteners. This allows children to take playthings in individual packets with them without taking the remaining packets and/or the base sheet.

While the packets 24 has been shown having Velcro fasteners to seal the flap 44, it should be recognized that the Velcro fasteners could be replaced by other fasteners such as snaps, zippers, or the like.

It can be seen from the foregoing discussion that a novel and unique article storage device has been described. The device can be used by either adults or children. It is portable and yet able to be easily mounted to a support structure. Still further, the device may be folded into a case for carrying the stored articles.

The device has the further advantage that the packets may be individually removed from the storage system, used separately, and later replaced. Still further, different dimensioned and different color accent packets can be used with a single base sheet.

While each packet 24 is mounted to the longitudinally extending strips 18 by a single substantially horizontally extending strip 46, it should be recognized that more than one strip 46 may be employed if desired.

In a variation of the present invention, the system may include more than one base sheet. The base sheets may be joined together in any desirable manner. For example, one base sheet may be joined to another base sheet by strips of Velcro affixed to each sheet adjacent upper and lower edges thereof. Similarly, two base sheets may be joined together side by side by strips of Velcro affixed to the side edges of each sheet.

It is apparent that there has been provided in accordance with this invention an article storage system which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A system for storing articles, said system comprising:

a substantially solid, substantially planar base sheet having a desired length and width;

said base sheet being formed from a flexible material;

reinforcement means attached about the periphery of said base sheet;

at least one packet for storing an article; and means for releasably attaching said at least one packet to said base sheet.

2. A system for storing articles, said system comprising:

a substantially solid, substantially planar base sheet having a desired length and width;

said base sheet being formed from a flexible material;

at least one packet for storing an article;

means for releasably attaching said at least one packet to said base sheet;

said attaching means comprising at least two strips of Velcro affixed to said sheet; and each said Velcro strip extending substantially the entire length of said sheet.

3. The system of claim 2 wherein said attaching means further comprises:

a mating strip of Velcro affixed to an upper portion of each said packet; and said mating strip extending substantially perpendicular to said at least two Velcro strips affixed to said sheet; and said mating strip contacting each said Velcro strip so as to secure said packet to said base sheet.

4. The system of claim 1 wherein said sheet and each said packet is formed from a clear plastic material.

5. The system of claim 1 wherein said base sheet may be folded around said at least one packet so as to form a carrying case surrounding said packet.

6. The system of claim 5 further comprising handle means secured to a surface of said base sheet for carrying said system when said base sheet forms said carrying case.

7. The system of claim 1 further comprising:

means for enabling said base sheet to be mounted to a support.

8. The system of claim 7 wherein said enabling means comprises a series of grommets affixed to said base sheet adjacent an upper edge of said base sheet.

9. The system of claim 8 further including:

means for suspending said base sheet from a support; and said suspension means being connected to at least one of said grommets.

10. The system of claim 2 further comprising:

fastening means affixed to a rear surface of said base sheet; and said fastening means being joined to said at least two Velcro strips when said base sheet is folded to form a carrying case.

11. The system of claim 10 wherein said fastening means comprises a Velcro strip.

12. A system for storing articles, said system comprising:

a substantially solid, substantially planar base sheet having a desired length and width;

said base sheet being formed from a flexible material;

at least one packet for storing an article;

each said packet comprising an article storage compartment defined by a front wall joined to a rear wall, an opening adjacent an upper edge of said front wall, and flap means for closing said opening;

said flap means being formed integrally with said rear wall and having means for securing said flap in a closed position; and means for releasably attaching said at least one packet to said base sheet.

13. The system of claim 12 further comprising:

said front wall having a piece of Velcro adjacent each side edge of said envelope; and said closing means comprising mating pieces of Velcro secured to an underside of said flap means.

14. The system of claim 12 wherein said means for releasably attaching said at lest one packet to said base sheet comprises:

at least two strips of Velcro affixed to a surface of said base sheet and running substantially the entire length of said base sheet; and at least one additional strip of Velcro affixed to the back wall of said packet, said at least one additional strip extending substantially perpendicular to the other Velcro strips and extending across substantially the entire width of said packet.

15. A portable device for storing articles which comprises:

a substantially planar sheet having a desired length and width;

at least two packets defining storage compartments attached to said sheet, each said packet being individually removable from said sheet;

said sheet and said packets being formed from the same material;

said sheet having a length sufficient to form a carrying case about said packets when said sheet is in a folded condition; and means for securing said sheet in said folded condition, whereby said storage device may be transported from one location to another.

16. The device of claim 15 wherein each of said packets has a width substantially equal to the width of said sheet.

17. The device of claim 15 wherein:

said device has three packets affixed to said sheet;

one of said packets having a width substantially equal to the width of said sheet; and the other packets each having a width substantially equal to one-half of the width of said sheet.

* * * * *